US011289059B2

(12) United States Patent
Pachet et al.

(10) Patent No.: US 11,289,059 B2
(45) Date of Patent: Mar. 29, 2022

(54) PLAGIARISM RISK DETECTOR AND INTERFACE

(71) Applicant: Spotify AB, Stockholm (SE)

(72) Inventors: François Pachet, Paris (FR); Pierre Roy, Paris (FR)

(73) Assignee: Spotify AB, Stockholm (SE)

( * ) Notice: Subject to any disclaimer, the term of this patent is extended or adjusted under 35 U.S.C. 154(b) by 0 days.

(21) Appl. No.: 16/802,308

(22) Filed: Feb. 26, 2020

(65) Prior Publication Data

US 2020/0372882 A1 Nov. 26, 2020

(30) Foreign Application Priority Data

May 23, 2019 (EP) ..... 19176232

(51) Int. Cl.
*G10H 1/00* (2006.01)
*G10H 1/38* (2006.01)

(52) U.S. Cl.
CPC ..... *G10H 1/0041* (2013.01); *G10H 1/383* (2013.01); *G10H 2210/061* (2013.01)

(58) Field of Classification Search
CPC . G10H 1/0041; G10H 1/383; G10H 2210/061
USPC ..... 84/609
See application file for complete search history.

(56) References Cited

U.S. PATENT DOCUMENTS 10,719,702 B2 * 7/2020 Saha ..... G06K 9/00456
2004/0261016 A1 * 12/2004 Glass ..... H04L 51/12 715/230
2005/0060643 A1 * 3/2005 Glass ..... G06F 40/169 715/205
2008/0141117 A1 * 6/2008 King ..... G06F 16/335 715/238
2010/0138404 A1 * 6/2010 Park ..... G06F 16/634 707/712
2010/0278453 A1 * 11/2010 King ..... G06F 40/169 382/321
2011/0025842 A1 * 2/2011 King ..... H04N 1/00758 348/135
2011/0202567 A1 * 8/2011 Bach ..... G06F 16/639 707/784

(Continued)

FOREIGN PATENT DOCUMENTS

EP 3508986 A1 7/2019
JP 2001-265324 A 9/2001

(Continued)

OTHER PUBLICATIONS

EP Office Action, Appln. No. EP 19 176 232.7, dated Dec. 9, 2020, 6 pages.

(Continued)

*Primary Examiner* — Christina M Schreiber
(74) *Attorney, Agent, or Firm* — Merchant & Gould P.C.

(57) ABSTRACT

Methods, systems and computer program products are provided for testing a lead sheet for plagiarism. A test lead sheet receiving having a plurality of passages is received at receiving a plagiarism detector. A set of annotations describing a level of plagiarism of a plurality of elements (e.g., chord sequence, subsequences, melodic fragments (i.e., notes), rhythm, harmony, etc.) of the test lead sheet in relation to the preexisting lead sheets are generated and output via an output device.

21 Claims, 10 Drawing Sheets

(56) References Cited

U.S. PATENT DOCUMENTS

| | | | | |
|---|---|---|---|---|
| 2013/0212090 | A1* | 8/2013 | Sperling | G06F 16/93 707/723 |
| 2014/0075566 | A1* | 3/2014 | Farkash | G06F 21/60 726/26 |
| 2014/0101540 | A1* | 4/2014 | King | G06F 40/143 715/255 |
| 2014/0168716 | A1* | 6/2014 | King | G06Q 10/10 358/473 |
| 2015/0317965 | A1* | 11/2015 | Horvath | G10H 7/00 84/609 |
| 2017/0097992 | A1* | 4/2017 | Vouin | G10L 25/51 |
| 2018/0061254 | A1* | 3/2018 | Amigud | G09B 5/00 |
| 2018/0096203 | A1* | 4/2018 | King | G06F 40/166 |
| 2019/0050388 | A1* | 2/2019 | Eugster | G06F 40/253 |
| 2019/0156162 | A1* | 5/2019 | King | G06K 9/00483 |
| 2019/0171665 | A1* | 6/2019 | Navlakha | G06F 16/532 |
| 2019/0347290 | A1* | 11/2019 | Yang | G10H 1/0058 |
| 2020/0074343 | A1* | 3/2020 | Pachet | G06N 20/00 |
| 2020/0372882 | A1* | 11/2020 | Pachet | G10H 1/383 |
| 2021/0064916 | A1* | 3/2021 | Maksimovic | G06F 16/683 |

FOREIGN PATENT DOCUMENTS

| | | | |
|---|---|---|---|
| JP | 2001265324 | A * | 9/2001 |
| JP | 2009-042401 | A | 2/2009 |

OTHER PUBLICATIONS

Extended European Search Report from European Appl'n No. 19176232.7, dated Nov. 18, 2019.

De Prisco et al.: "Visualization of Music Plagiarism: Analysis and Evaluation", 2016 20th Int'l Conf. Info. Visualisation (IV), IEEE, Jul. 19, 2016, pp. 177-182 (2016).

Park et al., "Music Plagiarism Detection Using Melody Databases", KES 2005, LNAI 3683, pp. 684-693 (2005).

Bandara et al., "A Machine Learning Based Tool for Source Code Plagiarism Detection", Int'l Journal of Machine Learning and Computing, vol. 1, No. 4, pp. 337-343 (Oct. 2011).

Dittmar et al., "Audio Forensics Meets Music Information Retrieval—A Toolbox for Inspection of Music Plagiarism", 2012 Proceedings of the 20th European Signal Processing Conf. (EUSIPCO), Bucharest, 2012, pp. 1249-1253.

Lee et al., "Music Plagiarism Detection System", Proceedings of the 26th Int'l Technical Conf. on Circuits/Systems, Computers and Communications (2011).

Lukashenko et al., "Computer-Based Plagiarism Detection Methods and To (2007).ols: An Overview", Int'l Conf. on Computer Systems and Technologies—CompSysTech'07.

"Music plagiarism detection", Fraunhofer Institute for Digital Media Technology IDMT (2018).

Martin et al., "Leadsheetjs: A javascript library for online lead sheet editing." 1st Int'l Conf. on Technologies for Music Notation and Representation (TENOR 2015), Paris, France (2015).

Good, Michael. "MusicXML: An internet-friendly format for sheet music." XML Conference and Expo. (2001).

Papadopoulos et al., "Assisted Lead Sheet Composition using Flowcomposer." Int'l Conf. on Principles and Practice of Constraint Programming, Springer, Cham, pp. 769-785 (2016).

Roy et al., "Sampling variations of lead sheets." arXiv preprint arXiv:1703.00760 (2017).

Müllensiefen et al., "Court decisions on music plagiarism and the predictive value of similarity algorithms" ESCOM '09, (2009).

Wolf et al,. "The perception of similarity in court cases of melodic plagiarism and a review of measures of melodic similarity." Int. Conf. of Students of Sustematic Musicology, 7 pages (2011).

* cited by examiner

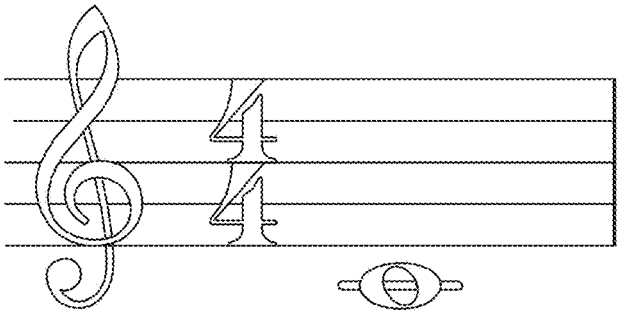

202

```
<?xml version="1.0" encoding="UTF-8" standalone="no"?>
<!DOCTYPE score-partwise PUBLIC
        "-//Recordare//DTD MusicXML 3.1 Partwise//EN"
        "http://www.musicxml.org/dtds/partwise.dtd">
<score-partwise version="3.1">
  <part-list>
    <score-part id="P1">
      <part-name>Music</part-name>
    </score-part>
  </part-list>
  <part id="P1">
    <measure number="1">
      <attributes>
        <divisions>1</divisions>
        <key>
          <fifths>0</fifths>
        </key>
        <time>
          <beats>4</beats>
          <beat-type>4</beat-type>
        </time>
        <clef>
          <sign>G</sign>
          <line>2</line>
        </clef>
      </attributes>
      <note>
        <pitch>
          <step>C</step>
          <octave>4</octave>
        </pitch>
        <duration>4</duration>
        <type>whole</type>
      </note>
    </measure>
  </part>
</score-partwise>
```

204

FIG. 2
PRIOR ART

800

My Lead Sheet Test Results

Click on Track ID to View/Listen to Comparison

| 510 Location | 520 Type | 530 Track ID | 540 Number of Works |
|---|---|---|---|
| Measures 3-5 | Chord Seq. | 1234, 1321, 1542, 1523 and 5434 | 5 |
| Measures 7-9 | Melody | 1234 | 1 |
| ⋮ | ⋮ | ⋮ | ⋮ |

FIG. 8

PLAGIARISM RISK DETECTOR AND INTERFACE

CROSS REFERENCE TO RELATED APPLICATIONS

This application claims benefit of Serial No. 19176232.7, filed May 23, 2019 in Europe and is incorporated herein by reference. To the extent appropriate, a claim of priority is made to the above-disclosed application.

TECHNICAL FIELD

Example aspects described herein relate generally relate to plagiarism detection, and more particularly to a plagiarism risk detector and interface.

BACKGROUND

Plagiarism is the practice of taking the work or ideas of someone else and passing them off as one's own. It has been around practically as long as humans have produced works of art and research. One form of plagiarism, music plagiarism, is the use or close imitation of another author's music while representing it as one's own original work. Music plagiarism comes in various forms, generally summarized as sampling plagiarism, rhythm plagiarism and melody plagiarism.

Sampling plagiarism involves the re-use of recorded sounds or music excerpts in another song and can include manipulating the samples in, for example, pitch or tempo to fit the rhythm and tonality of a new song. Rhythm plagiarism is the general copying of the rhythm that is formed by a periodical pattern of accents in the amplitude envelopes of different frequency bands and can include a rhythm that has undergone a number of manipulations, such as time stretching, pitch shifting, re-sampling or even shuffling of individual beats. Melody plagiarism is the general copying of the melodic motive of a work, and can include a melodic motive that has been copied and then transposed to another key, slowed down, sped up or interpreted with different rhythmic accentuation.

When executed manually, plagiarism detection is usually performed by experts and lawyers. Manual detection of music plagiarism requires substantial effort, skill and excellent memory, and is generally known to be impractical. Software-assisted detection for text plagiarism on the other hand allows vast collections of documents to be compared to each other, making successful plagiarism detection much more likely.

Technology in the area of music plagiarism detection makes successful detection much more likely. Lee, J. et al., "Music Plagiarism Detection System", ITC-CSCC (2011), for example, describes a system that detects music plagiarism based on melodic similarity. Melody is obtained using the harmonic structure model, and similarity between two melodies is calculated using the edit distance. The system extracts melody from the input query and finds melodies in a database that are close to the query melody as potential melodies which the query has plagiarized. The Lee et al. system is implemented with a graphical user interface (GUI). The system is composed of four modules: (1) Melody Extraction Module, (2) Melody-to-MIDI Module, (3) Similarity Calculation Modules and 4) Common Subsequence Search Modules. The system receives as input a polyphonic music (PCM data) and outputs information of plagiarized music (music title, time, etc.).

Christian Dittmar, et al., "Audio Forensics Meets Music Information Retrieval—A Toolbox For Inspection Of Music Plagiarism" (2012) describes approaches to detecting and inspecting sampling plagiarism, rhythm plagiarism, and melody plagiarism. Sampling plagiarism inspection is detected by comparing a time-frequency representation of two music excerpts. A time-frequency representation of both music excerpts is compared by computing a magnitude spectrogram by means of STFT. Each spectral frame is then converted to a constant-Q representation by means of re-sampling to a logarithmically spaced frequency axis, yielding the spectrograms of original $X_o$ and suspected plagiarism $X_s$ respectively. A number of hypotheses f for the applied re-sampling factor is derived by computing the pair-wise ratio of the strongest periodicities in the energy envelope of $X_o$ and $X_s$. In order to retrieve the occurrences of $X_o$ inside $X_s$, it is re-sampled both in time and frequency according to each entry in f, yielding $X_o$. Each $X_o$ is shifted frame-wise along all frames of $X_s$ and the accumulated, absolute difference d is computed between all corresponding time-frequency tiles.

Assuming only re-sampling and looping were applied, periodic minima will occur in d. These correspond to the point, where an optimal matching can be found. At this point, it is also possible to subtract the energy of $X_o$ from $X_s$, perform inverse short-time Fourier transform (STFT) and auralize the result. Dittmar et al. describe an alternative approach to detecting sampling plagiarism based on a decomposition of both $X_o$ and $X_s$ by means of Non-Negative Matrix Factorization (NMF).

Dittmar et al. also describe a rhythm plagiarism inspection technique that performs rhythmical source separation and tempo alignment. The rhythmical components of both $X_o$ and $X_s$ are again extracted by means of NMF. NMF is computed with large number of components that are, in turn, clustered. Features are extracted that indicate an assignment to a certain instrument. A measure is used for periodicity and all components that show a low percussiveness are removed. Afterwards, a clustering of the components performed. The assignment of components to each other is based on evaluating the correlation between the amplitude envelopes. A visualization can be presented in the plagiarism analyzer application for visual inspection by the user. The tempi of the sequences are aligned to each other. Finally, the extracted source from the original is compared to the extracted ones from the suspected plagiarism.

The score writing process typically involves writing music on a so-called "lead sheet". FIG. 1 illustrates an example prior art lead sheet. A lead sheet is a type of music score consisting of a monophonic melody 10 with associated chord labels 12, as shown in FIG. 1. Oftentimes, lead sheets also include lyrics 14 aligned with the melody.

A scorewriter, also sometimes referred to as a music editor or music notation program, is software used with a computer for creating, editing and printing lead sheets. A scorewriter is to music notation what a word processor is to text, in that they both allow fast corrections (undo), flexible editing, easy sharing of electronic documents (via the Internet or compact storage media) and uniform layout.

While the above techniques for detecting plagiarism are significant improvements over manual approaches, they still require significant expertise and are not suited for operation by typical artists and composers, especially artists and composers who are interested in detecting plagiarism during the composition process. Moreover, the above-described plagiarism techniques are not integrated with the tools such artists and composers use to notate their works during the score writing process.

What is lacking from the prior art is a graphical user interface (GUI) that is more intuitive, more precise as to the portion of the work that may be considered plagiaristic, and that provides dynamic visual feedback in substantially real-time. Such a tool would allow artists to generate lead sheets more quickly and confidently by detecting and providing visual feedback as to whether any aspect of the work has a probability of being deemed plagiaristic. The GUI interface of Lee et al., for example, provides an identification of the original song and other potentially similar songs. But the Lee et al. GUI does not provide specifics about what portion of the song might be the issue much less a GUI that visualizes the lead sheet in conjunction with plagiarism risk annotations.

Dittmar et al. provide more detailed visualizations of potential plagiaristic portions of a musical work. For example, the system of Dittmar et al. provides a visualization of the melody of an original work and the suspect plagiarism. However, similar to Lee J. et al., the Dittmar, C. et al. system does not provide a visualization of the underlying lead sheet nor its particulars in a format that is more easily interpreted and navigated, for example, by artists, composers as well as publishers or right owners who want to protect their assets or otherwise need to assess to which extent a musical work infringes.

It would be useful to have a technology or service that provides risk assessment for a complete musical work in the form of a lead sheet, continuously and online during the composition process. It would be useful to be able to edit a lead sheet using a scorewriter while receiving fast and specific plagiarism detection information, for instance as annotations of the work in progress, stressing the degree of similarity of the composition with regards to a database of existing works.

SUMMARY

In an example embodiment, a method for testing a lead sheet for plagiarism is provided. The method includes receiving, at a plagiarism detector, a test lead sheet having a plurality of passages, the plagiarism detector having been trained on a plurality of preexisting encoded lead sheets; generating a set of annotations describing a level of plagiarism of a plurality of elements (e.g., chord sequence, subsequences, melodic fragments (i.e., notes), rhythm, harmony, etc.) of the test lead sheet in relation to the preexisting encoded lead sheets; and presenting (e.g., outputting) via an output device, the annotations.

In some embodiments the method further includes displaying the test lead sheet on the output device; and displaying the set of annotations on the output device by overlaying the set of annotations over the lead sheet. In an example embodiment, displaying the set of annotations can includes: overlaying each annotation of the set of annotations over any one of (i) a corresponding melodic fragment, (ii) a chord sequence, or (iii) a combination of (i) and (ii) depicted on the lead sheet.

Each annotation can indicate a portion of the plurality of elements and a level of plagiarism of the portion of the plurality of elements (e.g., "the chord sequence appears in many works of the database", "the melodic fragment appears to be completely new", "the melodic fragment appears in some works of the database").

In some embodiments, the method performs training of the plagiarism detector on a plurality of preexisting encoded lead sheets.

In yet other embodiments, the method performs: comparing each segment of the encoded test lead sheet to the plurality of preexisting encoded lead sheets; calculating a similarity value indicating the similarity of the segment of the encoded test lead sheet to a corresponding segment of the plurality of preexisting encoded lead sheets; and labeling as a match a segment of the encoded test lead sheet having a similarity value that meets a similarity threshold.

In some embodiments, the method performs storing at least one encoded filter element; comparing the at least one encoded filter element to the plurality of preexisting encoded lead sheets; and filtering out any segments of the plurality of preexisting encoded lead sheets that match.

In another example embodiment, a plagiarism detector for testing a lead sheet for plagiarism is provided. The plagiarism detector includes one or more processors configured to: receive an encoded test lead sheet representing a test lead sheet having a plurality of passages; generate a set of annotations describing a level of plagiarism of a plurality of elements of the encoded test lead sheet in relation to a plurality of preexisting encoded lead sheets; and cause an output device to present the annotations.

In some embodiments, the at least one processor can configured to: cause the output device to: display the test lead sheet; and display the set of annotations by overlaying the set of annotations over the lead sheet.

In yet other embodiments, the at least one processor is further configured to cause the output device to: overlay each annotation of the set of annotations over any one of (i) a corresponding melodic fragment, (ii) a chord sequence, or (iii) a combination of (i) and (ii) depicted on the lead sheet.

In some embodiments, each annotation indicates a portion of the plurality of elements and a level of plagiarism of the portion of the plurality of elements.

In some embodiments, the at least one processor is further configured to: test the encoded test lead sheet against a model that has been trained on a plurality of preexisting encoded lead sheets.

In yet other embodiments, the at least one processor is further configured to: compare each segment of the encoded test lead sheet to the plurality of preexisting encoded lead sheets; calculate a similarity value indicating the similarity of the segment of the encoded test lead sheet to a corresponding segment of the plurality of preexisting encoded lead sheets; and label as a match a segment of the encoded test lead sheet having a similarity value that meets a similarity threshold.

Optionally, the plagiarism detector includes a negative filter database configured to store at least one encoded filter element. In this embodiment, the at least one processor further configured to: compare the at least one encoded filter element to the plurality of preexisting encoded lead sheets, and filter out any segments of the plurality of preexisting encoded lead sheets that match.

In yet another example embodiment, a non-transitory computer-readable medium having stored thereon one or more sequences of instructions for causing one or more processors to perform the methods described herein is provided.

BRIEF DESCRIPTION OF THE DRAWINGS

The features and advantages of the example embodiments of the invention presented herein will become more apparent from the detailed description set forth below when taken in conjunction with the following drawings.

FIG. 2 illustrates an example score consisting of a single whole note and its representation in an electronic file format.

FIG. 8 illustrates an example screenshot of plagiarism-related information associated with the test lead sheet.

DETAILED DESCRIPTION

Figure 1:
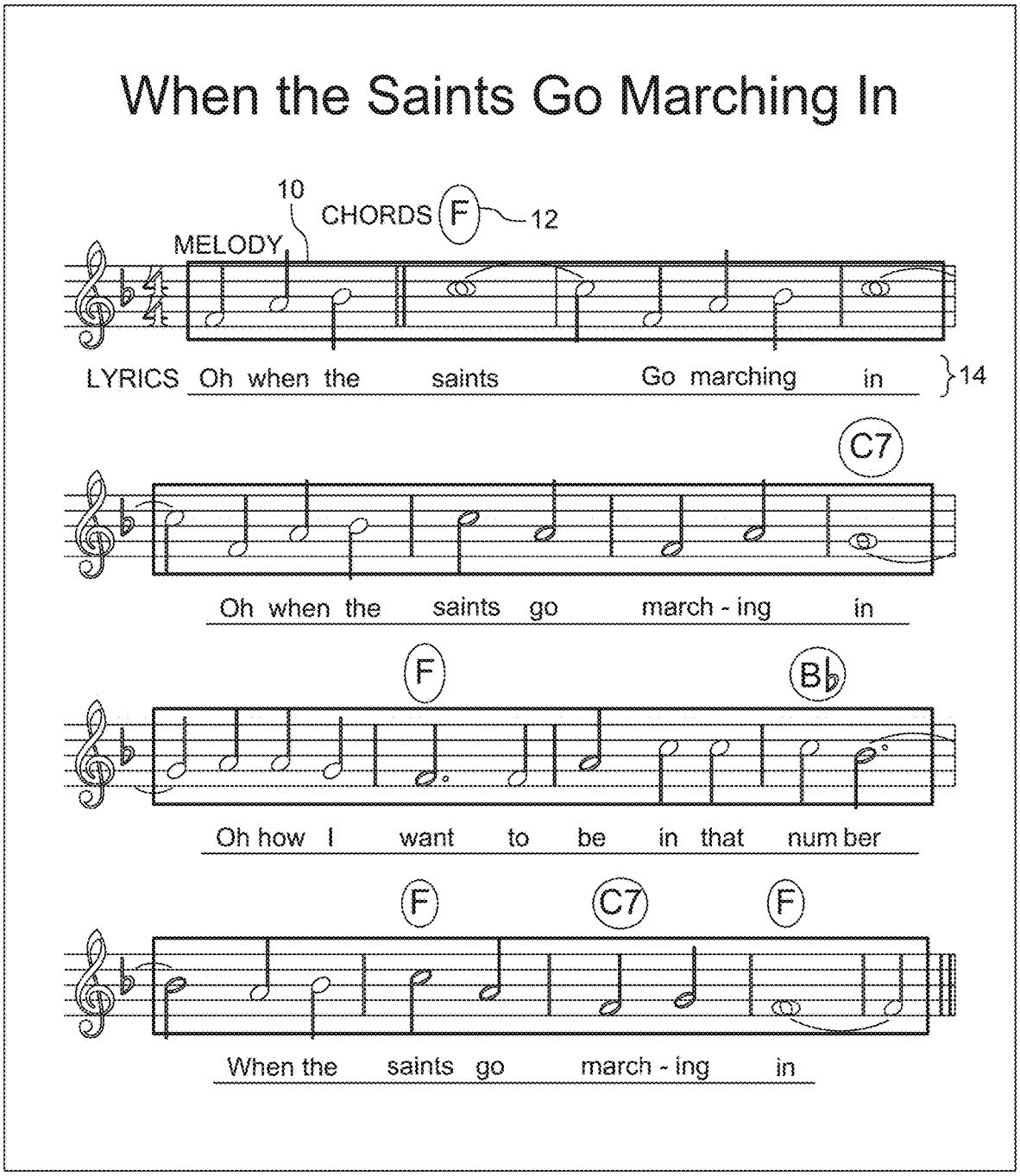
FIG. 1 PRIOR ART
FIG. 1 illustrates an example prior art lead sheet.

The example embodiments of the invention presented herein are directed to methods, systems and computer program products for plagiarism risk assessment, which are now described herein in terms of an example cloud-based service for assessing the probability that a musical work in the form of a lead sheet is plagiaristic and presenting a graphical user interface identifying any potentially plagiaristic portions of the lead sheet along with relevant information. This description is not intended to limit the application of the example embodiments presented herein. In fact, after reading the following description, it will be apparent to one skilled in the relevant art(s) how to implement the following example embodiments in alternative embodiments (e.g., as a dedicated hardware device, and/or involving different types of music scores such as chord charts, and the like).

Generally, lead sheets are encoded in a computer format referred to herein as a music interchange format and the music interchange formatted lead sheets are uploaded to a database. The music interchange format thus contains one or more sequences of information representing the content of a lead sheet. A plagiarism risk assessment service (e.g., that operates a plagiarism risk detector) uses the uploaded music interchange formatted lead sheets for detecting possible plagiarism of a test lead sheet that has also been encoded in the music interchange format. The plagiarism risk assessment service returns a set of annotations describing which aspects of the test lead sheet are similar to existing lead sheets in the database.

In some embodiments, the plagiarism risk assessment service provides the annotations in real-time, and causes a graphical user interface (GUI) to display the annotations. The plagiarism risk assessment GUI can work in conjunction with a scorewriter application GUI. In some embodiments the plagiarism risk assessment GUI is combined with the scorewriter application GUI to provide annotations in substantially real time as the lead sheet is being composed. In some embodiments, the plagiarism risk assessment service is implemented in the form of a plugin of an existing scorewriter.

Electronically Formatting a Lead Sheet

Musical structure generally is the overall organization of a composition into sections, phrases, and patterns, very much like the organization of a text. Songs, for example, include sections, phrases and patterns that can often be further decomposed into elements that include melody, chord progression, rhythm, and lyrics.

Common Western music notation is a symbolic method of representing music for performers and listeners. Besides its use in publishing sheet music, musical scores and parts, the notation has been encoded in different computer formats, referred to herein as a music interchange formats. One example music interchange format is MusicXML which is an XML based format intended to be used with scorewriter tools to parse and manipulate a musical score. MusicXML is one type of music interchange format that is designed to allow the interchange of music notation data between and among music notation editing and publishing programs, as well as music scanning programs. While the example embodiments of the invention presented herein are described as using MusicXML it should be understood that other music interchange formats can be used instead of Music XML. Alternative embodiments can use different types of music interchange formats such as msf, RMTF, MIDI, abc, reativeMusicFile, FinaleFormat, ETF, RhapsodyFormat, EncoreFormat, Noteworthy, GuitarProFormat, TablEditFormat, SmartScore, and the like.

FIG. 2 illustrates an example prior art score 202 consisting of a single whole note and its representation in a music interchange format 204. In this example, the score 202 consists of a single whole note middle C in the key of C major on the Treble Clef and its representation using MusicXML code.

Plagiarism Risk Detection System

Figure 3:
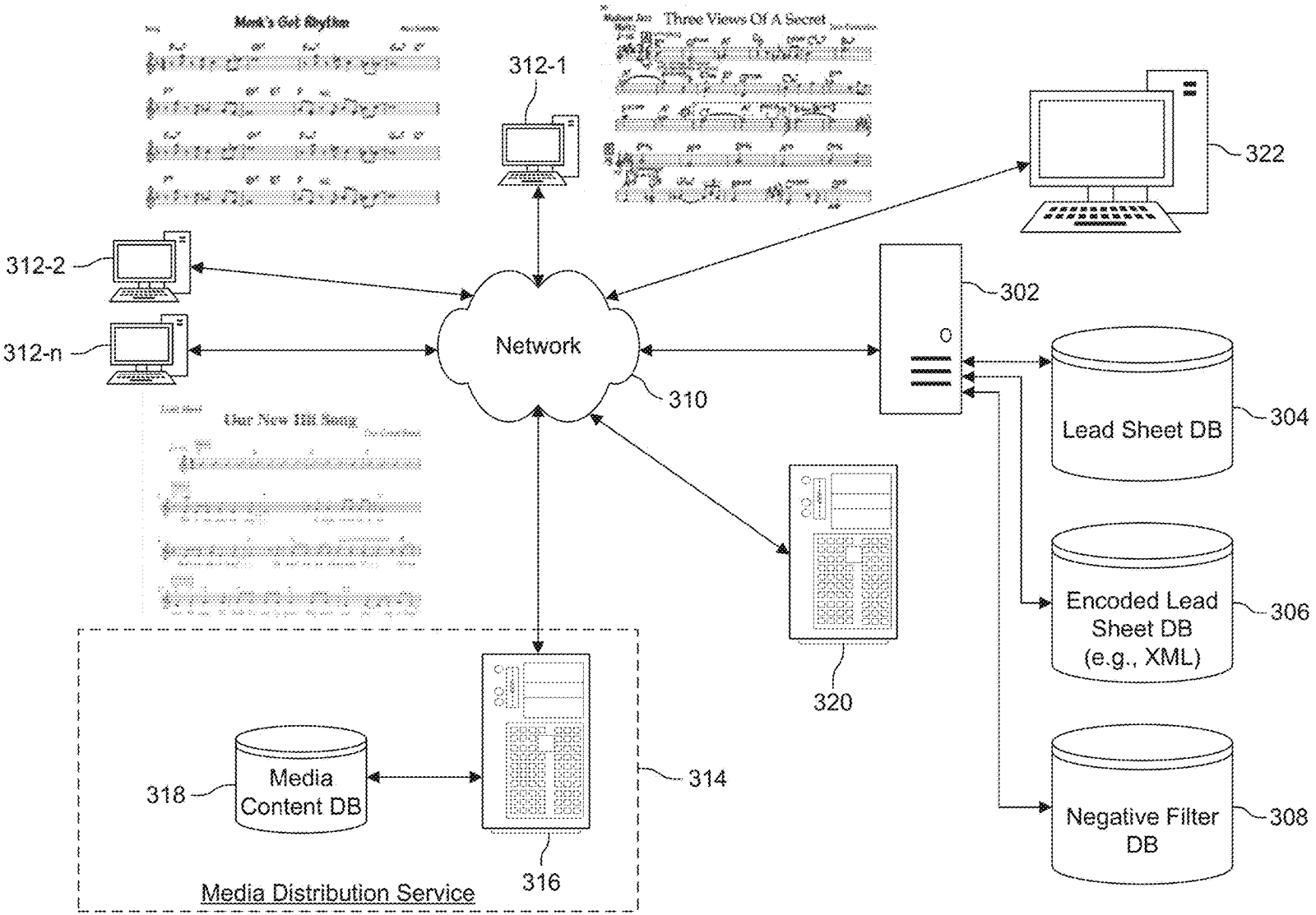
FIG. 3 illustrates a plagiarism risk detection system in accordance with an example embodiment of the present invention.

FIG. 3 illustrates a plagiarism risk detection system in accordance with an example embodiment of the present invention. A plagiarism risk detector 302 is coupled to one or more databases. In one example embodiment, plagiarism risk detector 302 is coupled to a lead sheet database 304. The lead sheet database 304 stores plural lead sheets in their native format. In another embodiment, plagiarism risk detector 302 is coupled to an encoded lead sheet database 306. An encoded lead sheet is a lead sheet that is encoded in a music interchange format. Encoded lead sheet database 306 stores encoded lead sheets (e.g., a corpus of lead sheets encoded in a music interchange format). In some embodiments, the plagiarism risk detector 302 includes at least one processor and a non-transitory memory storing instructions. When the instructions are executed by the at least one processor, the at least one processor performs the functions described herein.

In some embodiments, each encoded lead sheet is stored in encoded lead sheet database 306 as sequences $S_1$, $S_2$, . . . , $S_n$, where n is an integer.

In an example implementation, fingerprinting is performed on the segments of the sequences using a fingerprinting algorithm. Generally, a fingerprinting algorithm maps the data contained in the sequences (e.g., segments of the sequences) to, for example, shorter text strings. Such shorter text strings are known as fingerprints. These fingerprints are unique identifiers for their corresponding data and/or files. Now known or future developed mechanisms for fingerprinting and matching encoded test lead sheets to a corpus of encoded lead sheets stored in encoded lead sheet database 306 can be used.

In yet another example embodiment, plagiarism risk detector 302 is coupled to a negative filter database 308. In some embodiment, such elements are also encoded in a music exchange format and are referred to herein as encoded filter elements. Negative filter database 308 stores elements of musical scores that are viewed as non-plagiaristic. Negative filter database 308 is used, for example, to filter out matches that are permissible uses, common features of musical scores, or other sections, phrases, and/or patterns (e.g., melodies, chord progressions, rhythms, and lyrics) that are common or otherwise would report false positives for plagiarism. In an example implementation, a negative filter database 308 stores encoded filter elements $F_1, F_2, \ldots, F_x$, where x is an integer. The filtering process involves comparing segments of a collection of source sequences $S_1, S_2, \ldots, S_n$, where n is an integer (e.g., representing encoded lead sheets stored in an encoded lead sheet database 306) with segments of sequences of encoded filter elements $F_1, F_2, \ldots, F_x$, where x is an integer. The matched segments (e.g., the segments that are similar or substantially similar) are, in turn, filtered out. That is, the matched segments are filtered and not compared to a test lead sheet.

In an example embodiment, fingerprinting is performed on segments of sequences of the encoded filter elements stored in negative filter database 308. Fingerprinting is also performed on the segments of source sequences stored in encoded lead sheet database 306. In this embodiment, one or more fingerprints of the encoded filter elements are compared against the fingerprints of the encoded lead sheets. This reduces the amount of processing resources that need to be used to test an encoded test lead sheet by reducing the test data set that the encoded test lead sheet is compared against.

As shown in FIG. 3, plagiarism risk detector 302 is coupled to various sources of lead sheets 312-1, 312-2, . . . , **312-*n* via a network 310. In addition or alternatively, plagiarism risk detector 302 can be coupled to a media distribution service 314 that includes a music distribution server 316 and a media content database 318 that stores media content items. The media distribution service 314 can provide streams of media content or media content items for downloading to plagiarism risk detector 302. In one embodiment plagiarism risk detector 302 converts the music content of the media content items into encoded lead sheets. In turn, the encoded lead sheets are stored in encoded lead sheet database 306** for later processing.

In another example embodiment, a notation service 320 converts media content (e.g., songs) from, for example media distribution service 314 into encoded lead sheets and supplies the encoded lead sheets to encoded lead sheet database 306 for later processing.

As explained above segments of a collection of source sequences S1, S2, . . . , $S_n$, where n is an integer, representing encoded lead sheets are stored in the encoded lead sheet database 306. In some embodiments, fingerprints of the segments can be stored, for example to decrease the amount of time it takes to compare the segments, to increase the ability to make accurate comparisons, and to reduce processing resources.

Plagiarism risk detector 302 uses the encoded lead sheets stored in encoded lead sheet database 306 to detect possible plagiarism and provide a set of annotations describing which elements of a test lead sheets are similar to existing lead sheets in the encoded lead sheet database 306.

In some embodiments, plagiarism risk detector 302 is communicatively coupled to client device 322. In one embodiment, Plagiarism risk detector 302 is coupled to client device 322 via network 310. Client device 322 includes one or more processors and a non-transitory memory device storing an integrated scorewriting and plagiarism detection application, which when executed by the one or more processors causes the client device to operate as an integrated scorewriter and plagiarism detector.

Lead Sheet Conversion and Output Model Generation Procedures

Figure 4:
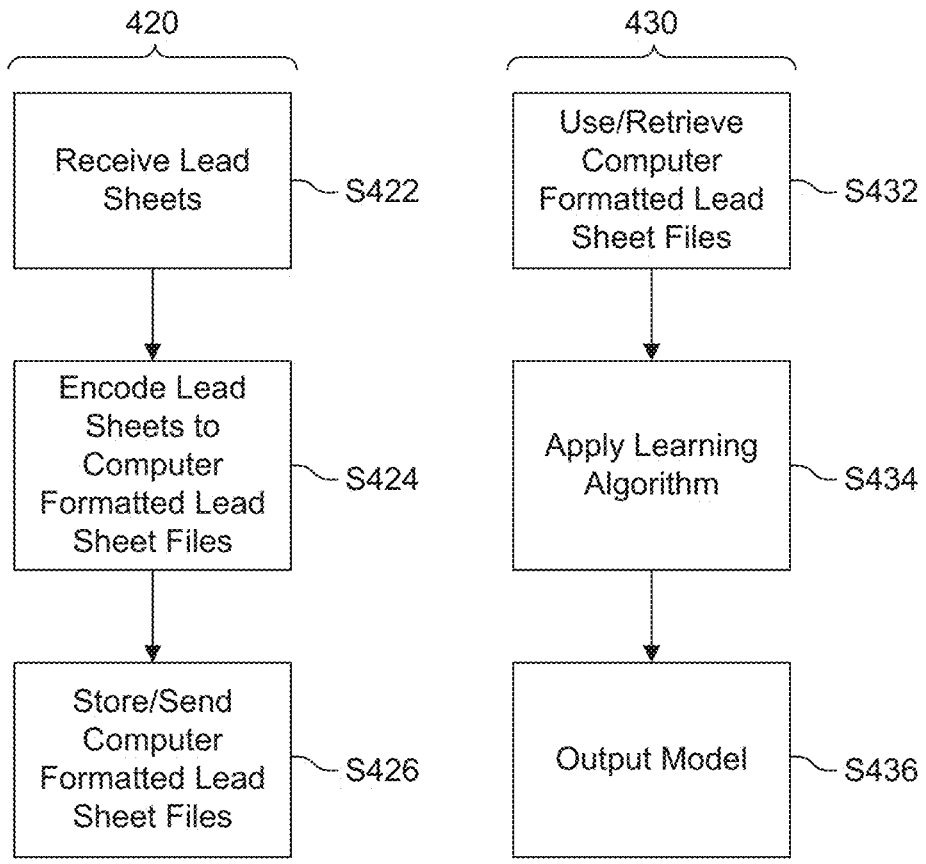
FIG. 4 depicts procedures for converting lead sheets to computer formatted lead sheet files and using the computer formatted lead sheet files to generate an output model in accordance with an example embodiment of the present invention.

FIG. 4 depicts a procedure for converting lead sheets to computer formatted lead sheet files 420 and a procedure for using the computer formatted lead sheet files to generate an output model 430 in accordance with an example embodiments of the present invention. At block S422, lead sheet encoding procedure 420 receives lead sheets in their native format and in block S424 encodes the lead sheets to generate a computer formatted lead sheet files, referred to herein as encoded lead sheets. In turn, the encoded lead sheets are stored in an encoded lead sheet database (e.g., FIG. 1, 306), as shown in block S426.

As described above, in some embodiments, the computer format used to generate computer formatted lead sheet files is a music interchange format. In some example embodiments lead sheet encoding procedure 420 transmits the encoded lead sheets to another service or system for further processing. Lead sheet learning procedure 430 is such a processing service.

Lead sheet learning procedure 430 retrieves the encoded lead sheet files as shown in block S432, performs a learning algorithm on the computer formatted lead sheet files S434, and generates an output model S436. The machine learning algorithm that is used to generate the output model is not limited to any machine algorithm implementation. Indeed, in some embodiments, combining multiple base learners can result in improved prediction performance. Those skilled in the art will appreciate that now known or future developed learning algorithms can be used to train the output model.

Lead Sheet Plagiarism Detection Procedure

Figure 5A:
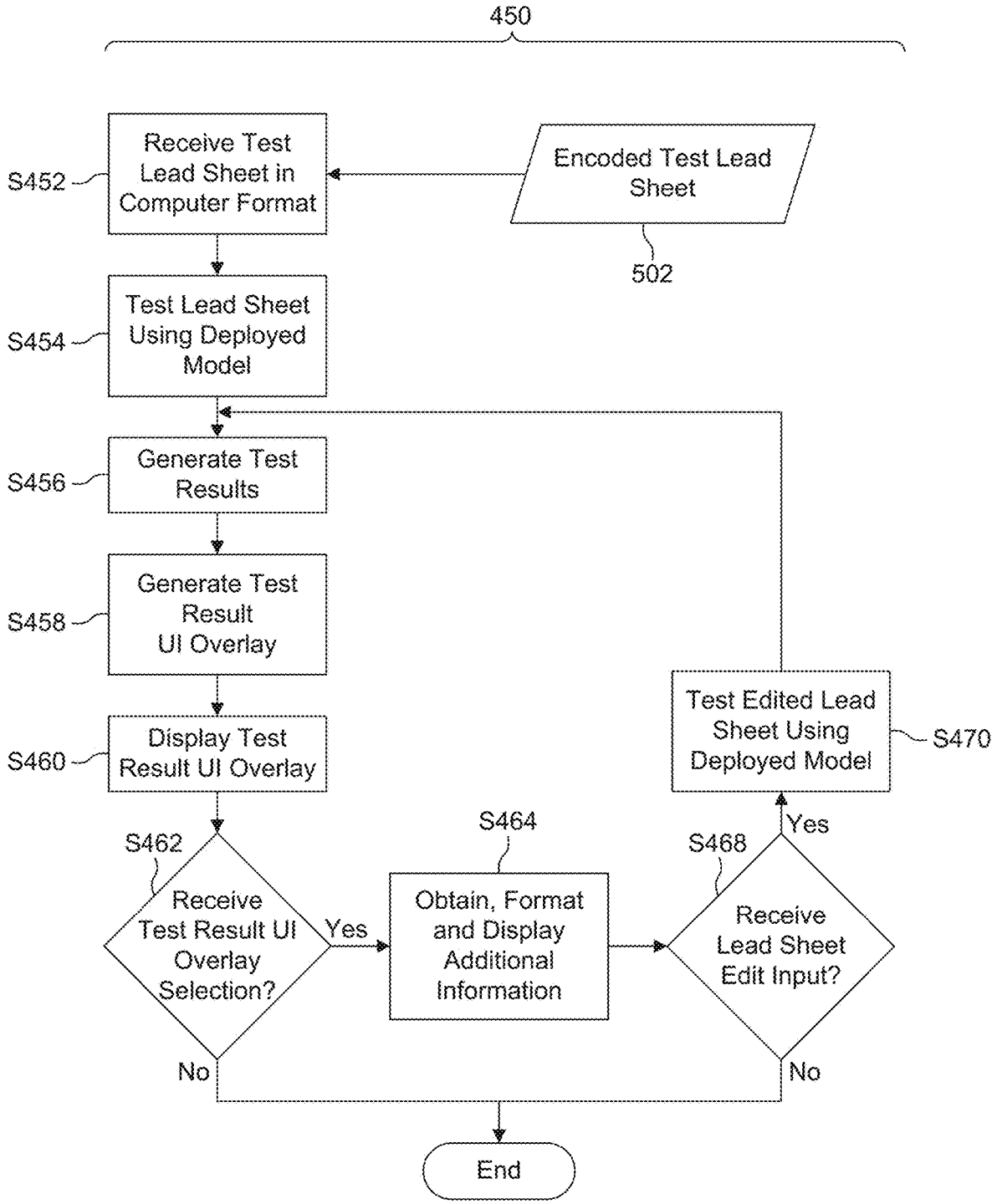
FIG. 5A illustrates a procedure for testing a lead sheet to determine the probability that a component of the lead sheet plagiarizes an attributed work, in accordance with an example embodiment of the present invention.

FIG. 5A illustrates a procedure 450 for testing a lead sheet to determine the probability that a component of the lead sheet plagiarizes an attributed work, in accordance with an example embodiment of the present invention.

In block S452, an encoded test lead sheet is received. The encoded test lead sheet 502 is also sometimes referred to as a query lead sheet.

If a lead sheet to be tested is not already in a music interchange formats, the lead sheet is converted into an encoded lead sheet file 502.

In the example embodiment depicted in FIG. 5A, the encoded test lead sheet 502 is in a music interchange format as described above.

Figure 6:
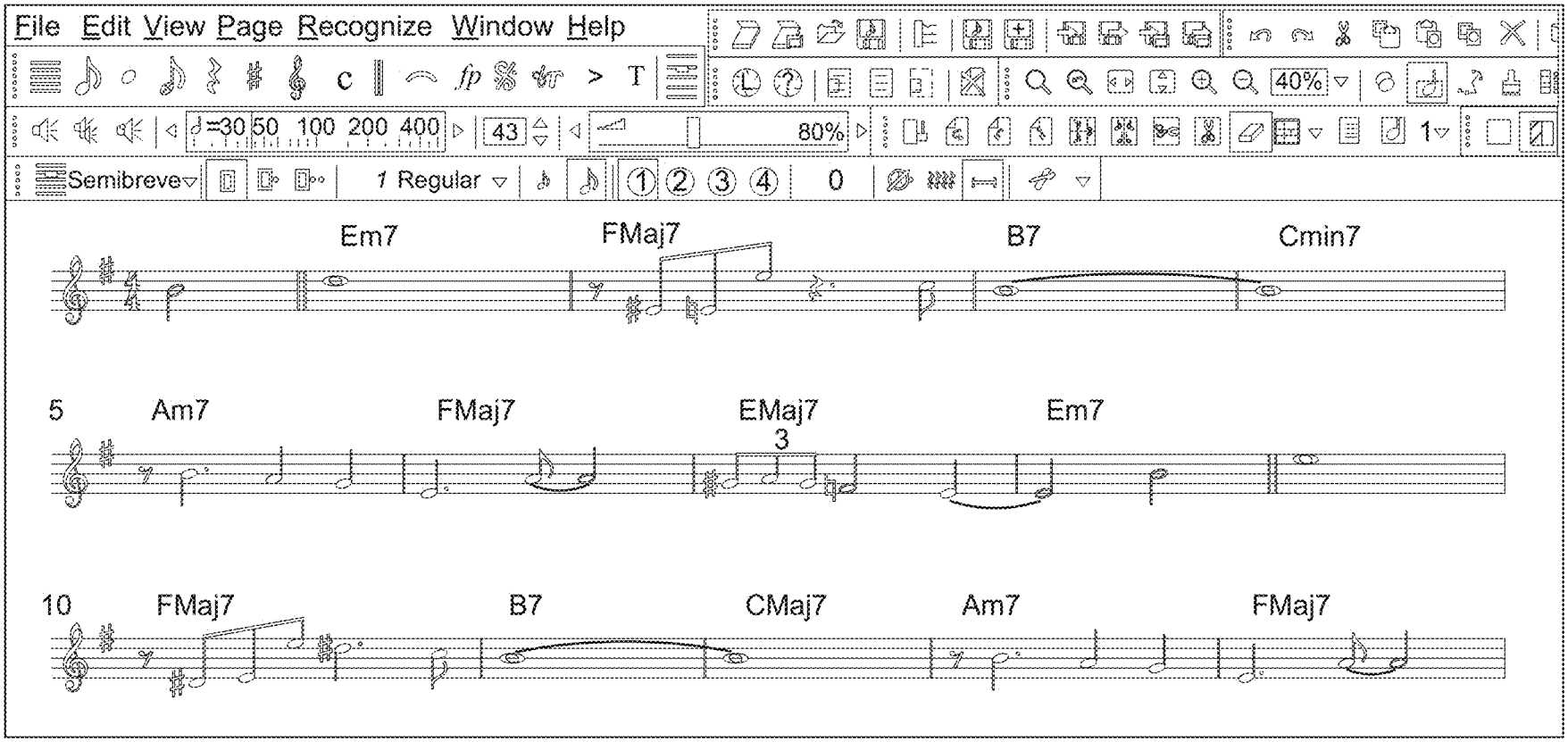
FIG. 6 is a test lead sheet prepared using a scorewriter to be analyzed according to the example embodiments of the present invention.

An example test lead sheet is illustrated in FIG. 6. In the example shown in FIG. 6, the test lead sheet is a lead sheet that is prepared using a scorewriter application. The scorewriter application saves an encoded version of the test lead sheet (i.e., the encoded test lead sheet) in a memory store (either locally, e.g., on a disk drive or remotely, e.g., on the cloud). In some embodiments, the encoded test lead sheet is updated in real time as changes to the lead sheet are being made through the use of the socrewriter application.

In block S454, the test lead sheet is evaluated against a corpus of encoded lead sheets. This can be accomplished in a number of ways.

Figure 5B:
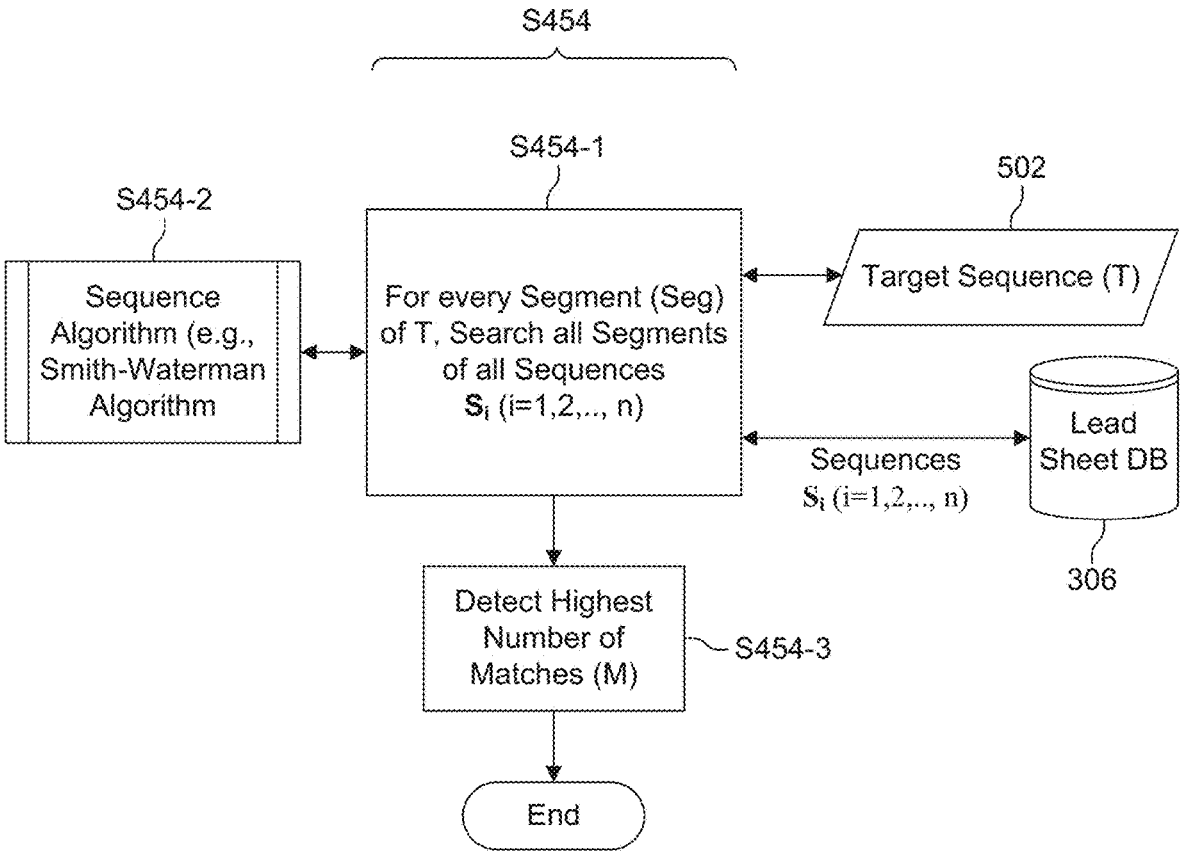
FIG. 5B illustrates an example implementation of testing a lead sheet using a model in accordance with an example embodiment of the present invention.

FIG. 5B illustrates an example implementation of testing a lead sheet using a model (block S454 of FIG. 5A) in accordance with an example embodiment of the present invention.

In some embodiments, the encoded test lead sheet is formatted as a sequence (e.g., a digitized chord sequence, a digitized subsequence, and the like). Referring to FIG. 5B, such an encoded test lead sheet is also referred to as a target sequence T 502. Given the target sequence T 502 and given a collection of source sequences $S_1$, $S_2$, (e.g., representing preexisting encoded lead sheets stored in an encoded lead sheet database 306), a search is performed for every segment Seg of T 502 for a list of all segments of all sequences $S_i$ (i=1,2,.., n, where i is an integer) that are similar to Seg, using, for example, a similarity measure, as shown in block S454-1 of FIG. 5B. A similarity measurement, e.g., performed by a processor referred to for convenience as a similarity test processor, generates a quantity that reflects the strength of a relationship between two objects or two features, referred to herein as a similarity value. Here the similarity measurement generates a quantity that reflects the strength of the relationship between a segment (Seg) of an encoded test lead sheet to one or more segments of preexisting encoded lead sheets stored in encoded lead sheet database 306. This similarity measurement can be computed in many different ways. For example, the similarity measurement can be computed by performing a sequence alignment algorithm such as the Smith-Waterman algorithm, as shown in block S454-2.

In some embodiments, a method performs calculating a similarity value indicating the similarity of the segment of the encoded test lead sheet to a corresponding segment of the plurality of preexisting encoded lead sheets and identifying a segment of the encoded test lead sheet having a similarity value that meets a similarity threshold. The segment of the encoded test lead sheet having a similarity value that meets the similarity threshold is labeled as a match (i.e., as potentially plagiaristic), as shown in block S454-3.

With this information, the segments of the target sequence which have the highest number of matches M (M, where M is an integer) in the source collection can be identified as being potentially plagiaristic.

In some embodiments, the music score being composed, e.g., the target sequence T can be rendered as an audio file (e.g. using a MIDI synthesizer). Then sampling detection methods can be used to detect similar audio segments in the source collection (themselves rendered as audio files).

As used herein a musical element refers to sections, phrases, and patterns. With respect to songs, for example, the term musical element includes sections, phrases and patterns that can be further decomposed into elements that include melody, chord progression, rhythm, and lyrics.

Figure 7:
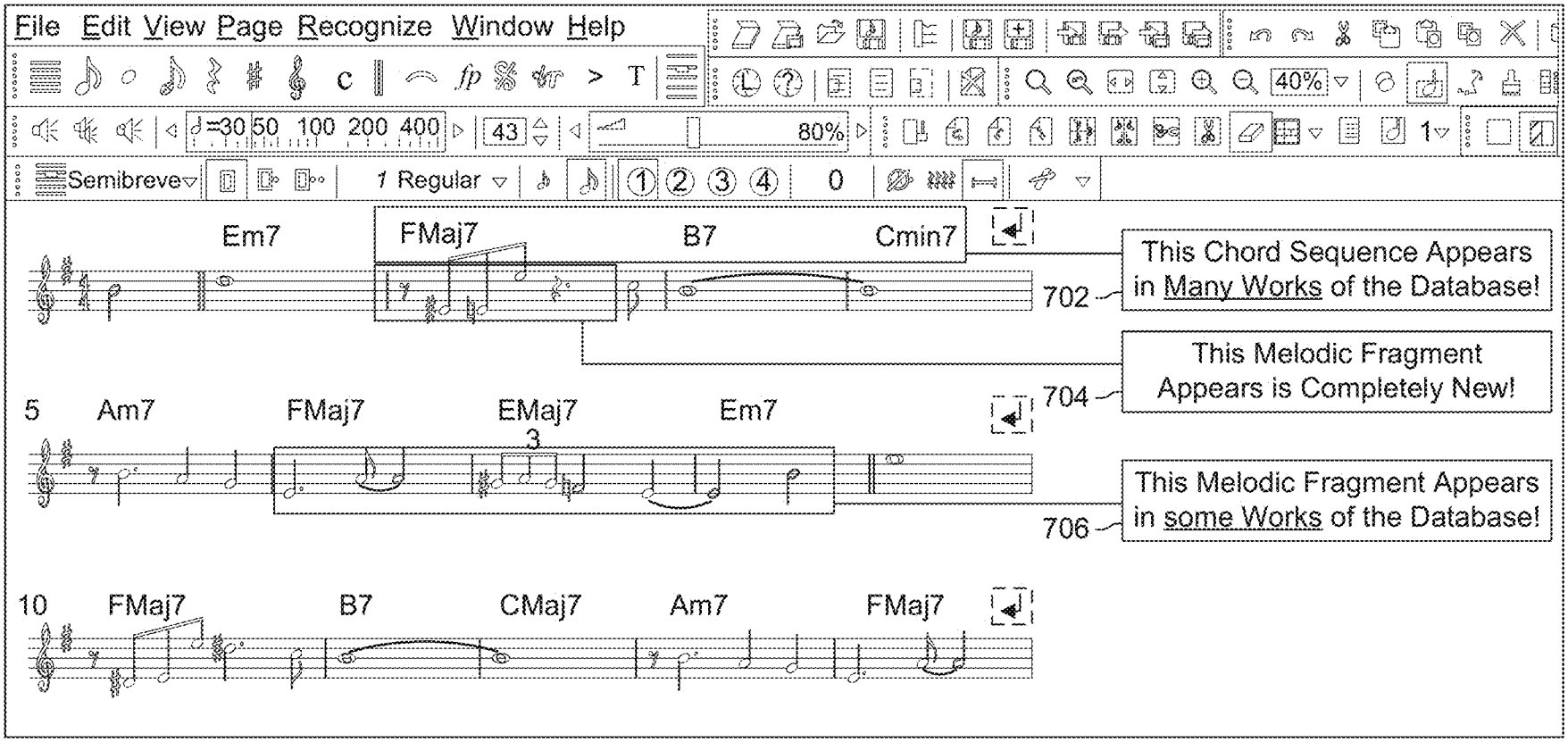
FIG. 7 is an example of a test results overlay in accordance with an example embodiment of the present invention.

Referring back to FIG. 5A, in block S456 test results are generated. In block S458, a user interface graphical overlay is generated based on the test results and overlaid onto the test lead sheet. FIG. 7 is an example of a test results overlay in accordance with an example embodiment of the present invention. I this example, the annotations illustrate whether chord sequences of the test lead sheet match the preexisting works. In one example implementation, a high probability of plagiarism message 702 is presented to the operator. In this example, the message states that a particular chord sequence in measure 3-5 of the test lead sheet appear in many works. In some embodiments, a message can be presented to the operator indicating that there appears to be no match. For example, as shown in FIG. 7, the interface is configured to present a message stating that a particular melodic fragment does not appear to be found 704. Yet another message can indicate to the operator that only some matches were found (e.g., less than a predetermined threshold). In the example depicted in FIG. 7, a melodic fragment at measures 7-9 of the test lead sheet has been flagged as being matched to some works 706.

In turn, in block S460, the test result user interface (UI) overlay is displayed to appear on top of (e.g., overlaid over) the lead sheet notation. At block S462 a determination is made whether a test result user interface overlay has been selected. If so, then at block S464 additional information is rendered onto the display. In some examples, the encoded test lead sheet can be updated in real time as changes (e.g., edits) to the lead sheet are being made through the use of a scorewriter application, for example. In such examples, the lead sheet edit input is received at block S468, and the edited lead sheet is tested using the model at block S470.

FIG. 8 illustrates an example screenshot 800 of plagiarism-related information associated with the test lead sheet, in accordance with an embodiment of the present invention. As shown in FIG. 8, the music annotations that are potentially plagiaristic are identified in terms of their locations 510. This can be, for example, the measures in the music score as depicted on the test lead sheet being generated using the scorewriter application. In some embodiments, the particular measures 510 that are potentially plagiaristic corresponds to the segments of sequences of the encoded test lead sheet that matched the encoded lead sheets that are stored in encoded lead sheet database 306. Also depicted in the test results summary is the type of plagiarism 520 that was detected (e.g., sampling, melody, rhythm, chord sequence).

In some embodiments a link to the media content item that might be infringed (e.g., a track of an album) is provided so that an operator can quickly select the link to listen to the potentially plagiarized work. The links (or the track identifiers) are illustrated here by track identifier 530. However, other forms of identification can be used (E.g., name of song). The number of works 540 potentially plagiarized can also be presented via interface 800.

It will be recognized by those skilled in the art that additional information can be provided via the user interface. For example, a plagiarism probability value (not shown) of the potential plagiarism can be displayed. The calculation can be based on the similarity value. Those skilled in the art will recognize that additional information can be displayed and still be within the scope of the invention.

The example embodiments presented herein may be provided as a computer program product, or software, that may include an article of manufacture on a machine accessible or machine readable medium having instructions. The instructions on the non-transitory machine accessible machine readable or computer-readable medium may be used to program a computer system or other electronic device. The machine or computer-readable medium may include, but is not limited to, optical disks, CD-ROMs, and magneto-optical disks or other type of media/machine-readable medium suitable for storing or transmitting electronic instructions. The techniques described herein are not limited to any particular software configuration. They may find applicability in any computing or processing environment. The terms "computer-readable", "machine accessible medium" or "machine readable medium" used herein shall include any medium that is capable of storing, encoding, or transmitting a sequence of instructions for execution by the machine and that cause the machine to perform any one of the methods described herein. Furthermore, it is common in the art to speak of software, in one form or another (e.g., program, procedure, process, application, module, unit, logic, and so on) as taking an action or causing a result. Such expressions are merely a shorthand way of stating that the execution of the software by a processing system causes the processor to perform an action to produce a result.

Portions of the example embodiments of the invention may be conveniently implemented by using a conventional general purpose computer, a specialized digital computer and/or a microprocessor programmed according to the teachings of the present disclosure, as is apparent to those skilled in the computer art. Appropriate software coding may readily be prepared by skilled programmers based on the teachings of the present disclosure.

Some embodiments may also be implemented by the preparation of application-specific integrated circuits, field programmable gate arrays, or by interconnecting an appropriate network of conventional component circuits.

Some embodiments include a computer program product. The computer program product may be a storage medium or media having instructions stored thereon or therein which can be used to control, or cause, a computer to perform any of the procedures of the example embodiments of the invention. The storage medium may include without limitation an optical disc, a Blu-ray Disc, a DVD, a CD or CD-ROM, a micro-drive, a magneto-optical disk, a ROM, a RAM, an EPROM, an EEPROM, a DRAM, a VRAM, a flash memory, a flash card, a magnetic card, an optical card, nanosystems, a molecular memory integrated circuit, a RAID, remote data storage/archive/warehousing, and/or any other type of device suitable for storing instructions and/or data.

Stored on any one of the computer readable medium or media, some implementations include software for controlling both the hardware of the general and/or special computer or microprocessor, and for enabling the computer or microprocessor to interact with a human user or other mechanism utilizing the results of the example embodiments of the invention. Such software may include without limitation device drivers, operating systems, and user applications. Ultimately, such computer readable media further includes software for performing example aspects of the invention, as described above.

Included in the programming and/or software of the general and/or special purpose computer or microprocessor are software modules for implementing the procedures described above.

Figure 9:
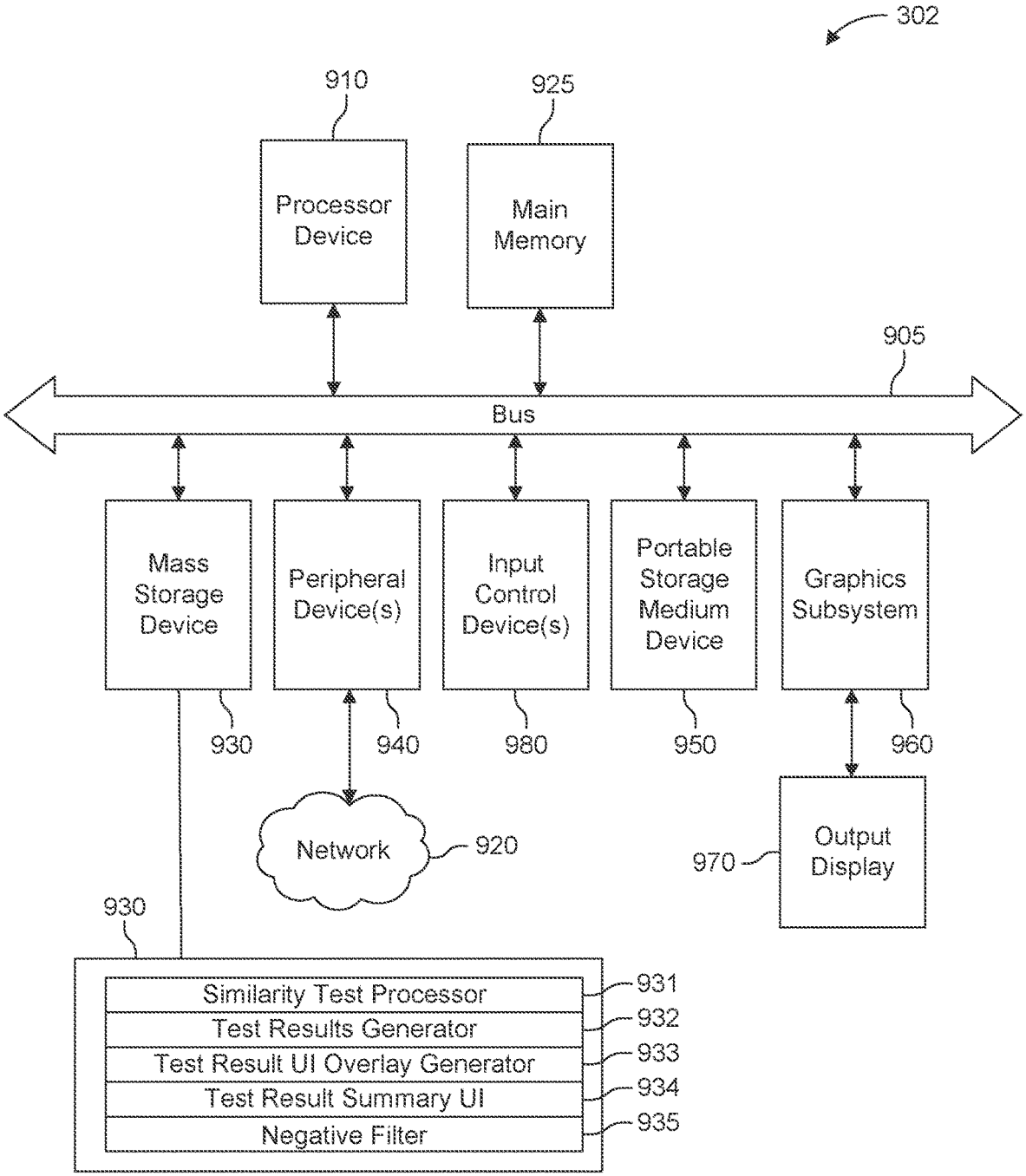
FIG. 9 is a block diagram for explaining additional details of a media control device with a single control input according to the example embodiments described herein.

FIG. 9 is a block diagram for explaining further details of a plagiarism risk detector 302 in accordance with some of the example embodiments described herein. Plagiarism risk detector 302 includes a processor device 910, a main memory 925, and an interconnect bus 905. The processor device 910 may include without limitation a single microprocessor, or may include a plurality of microprocessors for configuring the plagiarism risk detector 302 as a multiprocessor system. The main memory 925 stores, among other things, instructions and/or data for execution by the processor device 910. The main memory 925 may include banks of dynamic random access memory (DRAM), as well as cache memory.

The plagiarism risk detector 302 may further include a mass storage device 930, peripheral device(s) 940, portable non-transitory storage medium device(s) 950, input control device(s) 980, a graphics subsystem 960, and/or an output display interface 970. For explanatory purposes, all components in the plagiarism risk detector 302 are shown in FIG. 9 as being coupled via the bus 905. However, the plagiarism risk detector 302 is not so limited. Elements of the plagiarism risk detector 302 may be coupled via one or more data transport means. For example, the processor device 910 and/or the main memory 925 may be coupled via a local microprocessor bus. The mass storage device 930, peripheral device(s) 940, portable storage medium device(s) 950, and/or graphics subsystem 960 may be coupled via one or more input/output (I/O) buses. The mass storage device 930 may be a nonvolatile storage device for storing data and/or instructions for use by the processor device 910. The mass storage device 930 may be implemented, for example, with a magnetic disk drive or an optical disk drive. In a software embodiment, the mass storage device 930 is configured for loading contents of the mass storage device 930 into the main memory 925.

Mass storage device 930 additionally stores code for executing the similarity measurement (e.g., similarity test processor) 931, test result generator 932, test results overlay generator 933, test result user interface UI 934, and negative filter 935. Similarity test processor 931 receives encoded lead sheets in a and performs a similarity measurement to determine whether any segments of sequences of the test lead sheet potentially plagiarizes any segments of sequences of preexisting encoded lead sheets. Test result generator 932 generates the test results based on a comparison of the test lead sheet against the corpus of test lead sheets. Test result user interface (UI) overlay generator 933 performs the rendering of the test results user interface overlay onto a screen, and Test results UI receives input and output from a client device on which a test music score is generated. Negative filter 935 performs negative filtering to filter out matches that are permissible uses, common features of musical scores, or other sections, phrases, and/or patterns (e.g., melodies, chord progressions, rhythms, and lyrics) that are common or otherwise would report false positives for plagiarism.

The portable storage medium device 950 operates in conjunction with a nonvolatile portable storage medium, such as, for example, flash memory, to input and output data and code to and from the plagiarism risk detector 302. In some embodiments, the software for storing information may be stored on a portable storage medium, and may be inputted into the plagiarism risk detector 302 via the portable storage medium device 950. The peripheral device(s) 940 may include any type of computer support device, such as, for example, an input/output (I/O) interface configured to add additional functionality to the plagiarism detector 302. For example, the peripheral device(s) 940 may include a network interface card for interfacing the plagiarism risk detector 302 with a network 920.

The input control device(s) 980 provide a portion of the user interface for a user of the plagiarism risk detector 302. The input control device(s) 980 may include a keypad and/or a cursor control device. The keypad may be configured for inputting alphanumeric characters and/or other key information. The cursor control device may include, for example, a handheld controller or mouse, a trackball, a stylus, and/or cursor direction keys. The plagiarism risk detector 302 may include an optional graphics subsystem 960 and output display 970 to display textual and graphical information. The output display 970 may include a display such as a CSTN (Color Super Twisted Nematic), TFT (Thin Film Transistor), TFD (Thin Film Diode), OLED (Organic Light-Emitting Diode), AMOLED display (Activematrix organic light-emitting diode), and/or liquid crystal display (LCD)-type displays. The displays can also be touchscreen displays, such as capacitive and resistive-type touchscreen displays.

The graphics subsystem 960 receives textual and graphical information, and processes the information for output to the output display 970. Input control devices 980 can control the operation and various functions of the plagiarism risk detector 302.

Input control devices 980 can include any components, circuitry, or logic operative to drive the functionality of the plagiarism detector 302. For example, input control device (s) 980 can include one or more processors acting under the control of an application.

Also shown FIG. 9 is media playback device 990. As described above, the plagiarism risk detector 302 can have its own media playback component or functionality or a media playback device 990 can be integrated into the plagiarism risk detector 302.

Various operations and processes described herein can be performed by the cooperation of two or more devices, systems, processes, or combinations thereof.

While various example embodiments of the invention have been described above, it should be understood that they have been presented by way of example, and not limitation. It is apparent to persons skilled in the relevant art(s) that various changes in form and detail can be made therein. Thus, the disclosure should not be limited by any of the above described example embodiments, but should be defined only in accordance with the following claims and their equivalents. Further, the Abstract is not intended to be limiting as to the scope of the example embodiments presented herein in any way. It is also to be understood that the procedures recited in the claims need not be performed in the order presented.

What is claimed is:

1. A method for testing a lead sheet for plagiarism, comprising the steps of:

training a machine learning model based on a plurality of preexisting encoded lead sheets;

receiving, at a plagiarism detector, an encoded test lead sheet representing a test lead sheet having a plurality of segments;

testing the encoded test lead sheet using the trained machine learning model to detect a level of plagiarism of a plurality of elements within one or more segments of the plurality of segments of the encoded test lead sheet in relation to the plurality of preexisting encoded lead sheets;

generating a set of annotations describing the level of plagiarism of the plurality of elements; and presenting, via an output device, the set of annotations.

2. The method according to claim 1, further comprising the steps of:

displaying the test lead sheet on the output device; and displaying the set of annotations on the output device by overlaying the set of annotations over the test lead sheet.

3. The method according to claim 2, wherein displaying the set of annotations includes:

overlaying each annotation of the set of annotations over any one of (i) a corresponding melodic fragment, (ii) a chord sequence, or (iii) a combination of (i) and (ii) depicted on the test lead sheet.

4. The method according to claim 1, wherein each annotation indicates a portion of the plurality of elements and a level of plagiarism of the portion of the plurality of elements.

5. The method according to claim 1, wherein testing the encoded test lead sheet using the trained machine learning model further comprises the step of:

for each segment of the plurality of segments of the encoded test lead sheet, determining a similarity value between the segment and each of a plurality of segments of the plurality of preexisting encoded lead sheets.

6. The method according to claim 5, further comprising the steps of:

labeling as a match a segment of the encoded test lead sheet and a corresponding segment of the plurality of preexisting encoded lead sheets having a similarity value that meets a similarity threshold.

7. The method according to claim 1, wherein a negative filter database coupled to the plagiarism detector stores a plurality of encoded filter elements, and the method further comprising the steps of:

comparing at least one encoded filter element of the plurality of encoded filter elements to the plurality of preexisting encoded lead sheets; and filtering out any segments of the plurality of preexisting encoded lead sheets that match.

8. A plagiarism detector for testing a lead sheet for plagiarism, comprising:

at least one processor operable to:

train a machine learning model based on a plurality of preexisting encoded lead sheets;

receive an encoded test lead sheet representing a test lead sheet having a plurality of segments;

test the encoded test lead sheet using the trained machine learning model to detect a level of plagiarism of a plurality of elements within one or more segments of the plurality of segments of the encoded test lead sheet in relation to the plurality of preexisting encoded lead sheets;

generate a set of annotations describing the level of plagiarism of the plurality of elements; and cause an output device to present the set of annotations.

9. The plagiarism detector according to claim 8, the at least one processor further configured to:

cause the output device to:

display the test lead sheet; and display the set of annotations by overlaying the set of annotations over the test lead sheet.

10. The plagiarism detector according to claim 9, the at least one processor further configured to cause the output device to:

overlay each annotation of the set of annotations over any one of (i) a corresponding melodic fragment, (ii) a chord sequence, or (iii) a combination of (i) and (ii) depicted on the test lead sheet.

11. The plagiarism detector according to claim 8, wherein each annotation indicates a portion of the plurality of elements and a level of plagiarism of the portion of the plurality of elements.

12. The plagiarism detector according to claim 8, wherein to test the encoded test lead sheet using the trained machine learning model, the at least one processor further configured to:

for each segment of the plurality of segments of the encoded test lead sheet, determine a similarity value between the segment and each of a plurality of segments of the plurality of preexisting encoded lead sheets.

13. The plagiarism detector according to claim 12, the at least one processor further configured to:

label as a match a segment of the encoded test lead sheet and a corresponding segment of the plurality of preexisting encoded lead sheets having a similarity value that meets a similarity threshold.

14. The plagiarism detector according to claim 8, further comprising:

a negative filter database coupled to the plagiarism detector and configured to store a plurality of encoded filter elements; and the at least one processor further configured to:

compare at least one encoded filter element of the plurality of encoded filter elements to the plurality of preexisting encoded lead sheets, and filter out any segments of the plurality of preexisting encoded lead sheets that match.

15. A non-transitory computer-readable medium having stored thereon one or more sequences of instructions for causing one or more processors to perform:

training a machine learning model based on a plurality of preexisting encoded lead sheets;

receiving, at a plagiarism detector, an encoded test lead sheet representing a test lead sheet having a plurality of segments;

testing the encoded test lead sheet using the trained machine learning model to detect a level of plagiarism of a plurality of elements within one or more segments of the plurality of segments of the encoded test lead sheet in relation to the plurality of preexisting encoded lead sheets;

generating a set of annotations describing the level of plagiarism of the plurality of elements; and presenting, via an output device, the set of annotations.

16. The non-transitory computer-readable medium of claim 15, further having stored thereon a sequence of instructions for causing the one or more processors to perform:

displaying the test lead sheet on the output device; and displaying the set of annotations on the output device by overlaying the set of annotations over the test lead sheet.

17. The non-transitory computer-readable medium of claim 16, further having stored thereon a sequence of instructions for causing the one or more processors to perform:

overlaying each annotation of the set of annotations over at least one of (i) a corresponding melodic fragment, (ii) a chord sequence, or (iii) a combination of (i) and (ii) depicted on the test lead sheet.

18. The non-transitory computer-readable medium of claim 15 wherein each annotation indicates a portion of the plurality of elements and a level of plagiarism of the portion of the plurality of elements.

19. The non-transitory computer-readable medium of claim 15, further having stored thereon a sequence of instructions for causing the one or more processors to perform:

for each segment of the plurality of segments of the encoded test lead sheet, determining a similarity value between the segment and each of a plurality of segments of the plurality of preexisting encoded lead sheets.

20. The non-transitory computer-readable medium of claim 19, further having stored thereon a sequence of instructions for causing the one or more processors to perform:

labeling as a match a segment of the encoded test lead sheet and a corresponding segment of the plurality of preexisting encoded lead sheets having a similarity value that meets a similarity threshold.

21. The non-transitory computer-readable medium of claim 15, wherein a negative filter database coupled to the plagiarism detector stores a plurality of encoded filter elements, and the non-transitory computer-readable medium further having stored thereon a sequence of instructions for causing the one or more processors to perform:

comparing at least one encoded filter element of the plurality of encoded filter elements to the plurality of preexisting encoded lead sheets; and filtering out any segments of the plurality of preexisting encoded lead sheets that match.

* * * * *